US009175503B2

(12) United States Patent
Herdman

(10) Patent No.: US 9,175,503 B2
(45) Date of Patent: Nov. 3, 2015

(54) DEVICE FOR LOCKING AN ARTICLE

(71) Applicant: Rodrick A. Herdman, West Chester, OH (US)

(72) Inventor: Rodrick A. Herdman, West Chester, OH (US)

( * ) Notice: Subject to any disclaimer, the term of this patent is extended or adjusted under 35 U.S.C. 154(b) by 0 days.

(21) Appl. No.: 14/211,757

(22) Filed: Mar. 14, 2014

(65) Prior Publication Data

US 2014/0260441 A1 Sep. 18, 2014

Related U.S. Application Data

(60) Provisional application No. 61/800,324, filed on Mar. 15, 2013.

(51) Int. Cl.
*E05B 37/16* (2006.01)
*E05B 37/00* (2006.01)

(52) U.S. Cl.
CPC ..... *E05B 37/16* (2013.01); *E05B 37/00* (2013.01); *Y10T 70/42* (2015.04)

(58) Field of Classification Search
CPC ..... E05B 37/00; E05B 37/163; E05B 37/16; F41A 17/46; F41A 17/544; Y10T 70/42
USPC ..... 70/14, 20, 22, 23, 57, 58, 62, 181, 202, 70/229, 386, 294, 295, 297, 299, 329, 298
See application file for complete search history.

(56) References Cited

U.S. PATENT DOCUMENTS 2,640,346 A * 6/1953 Giffin ..... 70/313
3,192,746 A * 7/1965 Lehman ..... 70/315
3,256,723 A * 6/1966 Lehman ..... 70/25
3,422,646 A 1/1969 Monahan
3,648,492 A 3/1972 Walters et al.
4,012,931 A 3/1977 Harunari
4,621,510 A * 11/1986 Scherbing ..... 70/491
4,787,224 A * 11/1988 Mesa ..... 70/313
4,794,768 A * 1/1989 Moser et al. ..... 70/165
5,704,152 A * 1/1998 Harrison et al. ..... 42/70.07
5,829,280 A * 11/1998 Chen ..... 70/49
6,357,271 B1 3/2002 Hsu
6,382,002 B1 5/2002 Chen
6,487,803 B1 * 12/2002 Yu ..... 42/70.07
6,550,299 B1 4/2003 Lin (Continued)

FOREIGN PATENT DOCUMENTS

EP 0000003 A1 * 12/1978 ..... E05B 37/16

OTHER PUBLICATIONS

International Search Report and Written Opinion, dated Sep. 15, 2014, for corresponding International Application No. PCT/US2014/027715, filed Mar. 14, 2014 (11 pages).

*Primary Examiner* — Lloyd Gall
*Assistant Examiner* — Amanda L Miller
(74) *Attorney, Agent, or Firm* — Hasse & Nesbitt LLC; Daniel F. Nesbitt

(57) ABSTRACT

A pin lock device for securing an article, including a lock base and a removable lock device that locks to the lock base. A plurality of control pins disposed in pin bores that communicate with a mounting post through tumbler channels. Alignment of recesses in the control pins releases the locking device from the post. The locking device allows the user to secure an article, such as a handgun, on the post in a secure and accessible manner.

9 Claims, 10 Drawing Sheets

(56) References Cited

U.S. PATENT DOCUMENTS

| | | | | |
|---|---|---|---|---|
| 6,560,910 | B1 * | 5/2003 | McLaren | 42/70.11 |
| 6,718,678 | B2 * | 4/2004 | Riebling et al. | 42/70.07 |
| 6,718,808 | B2 | 4/2004 | Yu | |
| 7,021,095 | B2 * | 4/2006 | Jensen | 70/389 |
| 2004/0118172 | A1 * | 6/2004 | Nall | 70/298 |
| 2005/0199027 | A1 | 9/2005 | Mannella | |
| 2008/0184748 | A1 | 8/2008 | Burmesch | |
| 2011/0036129 | A1 * | 2/2011 | Frantz | 70/57 |

* cited by examiner

DEVICE FOR LOCKING AN ARTICLE

CROSS-REFERENCE TO RELATED APPLICATIONS

This application claims the benefit of U.S. Provisional application 61/800,324, filed Mar. 15, 2013, the disclosure of which is incorporated by reference in its entirety.

FIELD OF THE INVENTION

The invention relates to a lockable device for locking an article, such as a handgun.

BACKGROUND OF THE INVENTION

The owners of certain articles, such as a handgun, want to have the article ready for use at any and all times, but need to maintain the article in a safe condition and state of operation for other persons, including friends, family members, children, guests and the like.

SUMMARY OF THE INVENTION

The present invention provides a lock device for securing an article, including a lock base and a removable lock member that locks to the lock base, the lock base having a proximal end and a distal end, including a post having a one or more grooves proximate the distal end; the lock member having a body, an axis, a front face, and a rear face, a post bore into the body along the axis and through the rear face into which the post is inserted, a plurality of pin bores disposed in the body and displaced radially from the post axis, a plurality of radial tumbler channels extending between each pin bore and post bore, and a plurality of button openings in the front face of the removable lock member in communication with each of the pin bores; a control pin disposed in each pin bore, the control pin having a body, a first end and an opposed second end, the first end including a button portion that extends through the button opening in the front face of a removable lock member, and having a pin recess formed in the body intermediate the first end and second end, the control pin moveable within the pin bore between an extended position with the button extending from the front face, and a depressed position disposed rearwardly from the extended position; and a tumbler disposed within each tumbler channel, configured for radial movement within the tumbler channel between at least a first position in which a portion of the tumbler extends into the groove of the post when disposed within the post bore, and a second position in which a portion of the tumbler extends into the pin recess.

In an aspect of the invention, the post is a cylindrical post.

In another aspect of the invention, the groove proximate the distal end of the post is an annular groove.

In an aspect of the invention, the lock member has a cylindrical body.

In another aspect of the invention, the axis of the lock member is a center axis.

The present invention provides a pin lock device for securing an article, including a lock base and a removable lock member that locks to the lock base, the lock base having a proximal end and a distal end, including a cylindrical post having an annular groove proximate the distal end; the cylindrical lock member having a body, a central axis, a front face, and a rear face, an central bore into the body along the central axis and through the rear face that is configures to accept the post, a plurality of pin bores disposed in the body and displaced radially from the central axis, a plurality of radial tumbler channels extending between each pin bore and central bore, and a plurality of button openings in the front face of the cylindrical lock member in communication with each of the pin bores; a control pin disposed in each pin bore, the control pin having a body, a first end and an opposed second end, the first end including a button portion that extends through the button opening in the front face of a cylindrical lock member, and having a pin recess formed in the body intermediate the first end and second end, the control pin moveable within the pin bore between an extended position with the button extending from the front face, and a depressed position disposed rearwardly from the extended position; and a tumbler disposed within each tumbler channel, configured for radial movement within the tumbler channel between at least one of the annular groove of the post when disposed within the central bore or the pin recess.

The invention also provides a method for mounting and securing an article having an opening, which can be a handgun or other firearm that has a trigger guard, comprising the steps of: a) providing the lock device including a removable lock member including a plurality of lock pins, and a lock post; b) mounting the article onto the lock device with the lock post through the opening of the article; c) depressing and holding a programmed lock combination of the plurality of lock pins; d) placing the removable lock member onto the lock post; and e) releasing the programmed lock combination of lock pins.

DETAILED DESCRIPTION OF THE INVENTION

Figure 1:
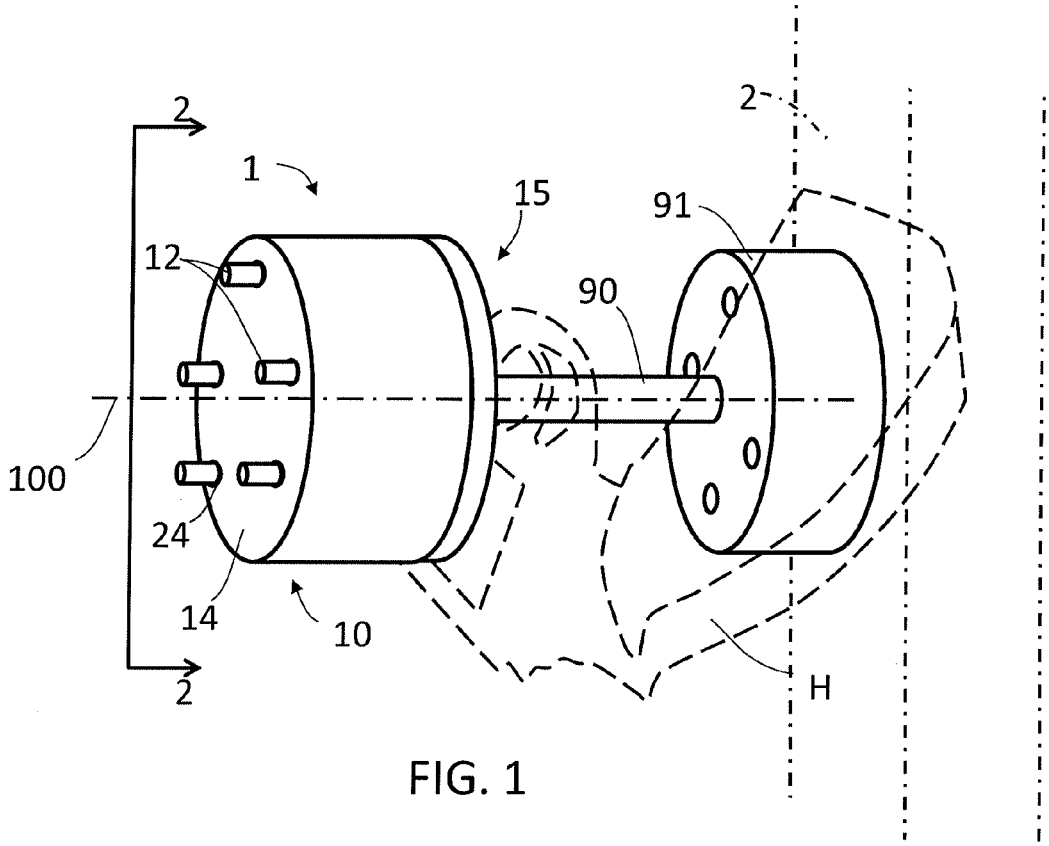
FIG. 1 shows a perspective view of the locking device of the invention secured to a post.

FIG. 1 shows a gun lock system 1 of the present invention. The system includes a push-button lockable device 10, and a post 90 onto which the lockable device 10 is securable. The post 90 can be secured to an immovable structure or fixture, including a structural wooden stud in the wall of a home, office or other building, or a moveable structure or fixture, including a gun case, dresser drawer, furniture, storage locker, a holster, a gun rack, glove box or storage compartment in an automobile, truck or other motor vehicle, etc. The illustrated embodiment shows the post 90 affixed to, or made integral with a base 91 that can be secured to a wooden stud in the wall of a home or apartment with a fastener, such as wood screws, nails, etc. An object or article, including but not limited to a handgun as illustrated, is secured by placing the locking device over the end of the post 90, and secured thereto by installing and securing the lockable device 10 over the end of the post 90.

Figure 2:
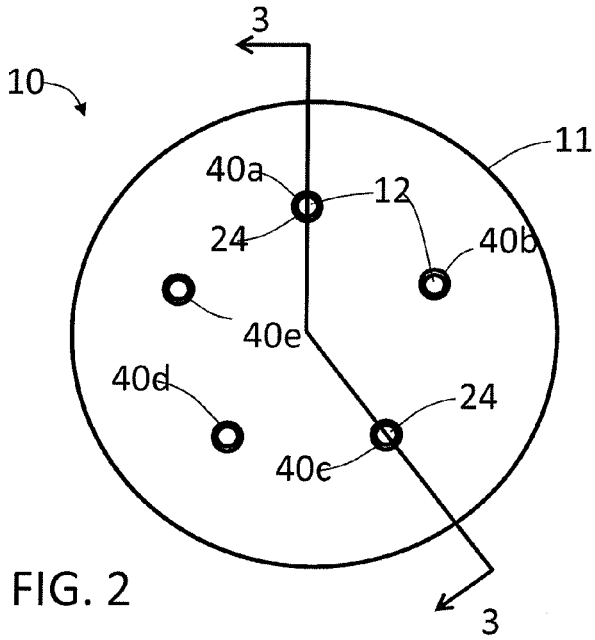
FIG. 2 shows a front face view of the locking device of FIG. 1.
Figure 3:
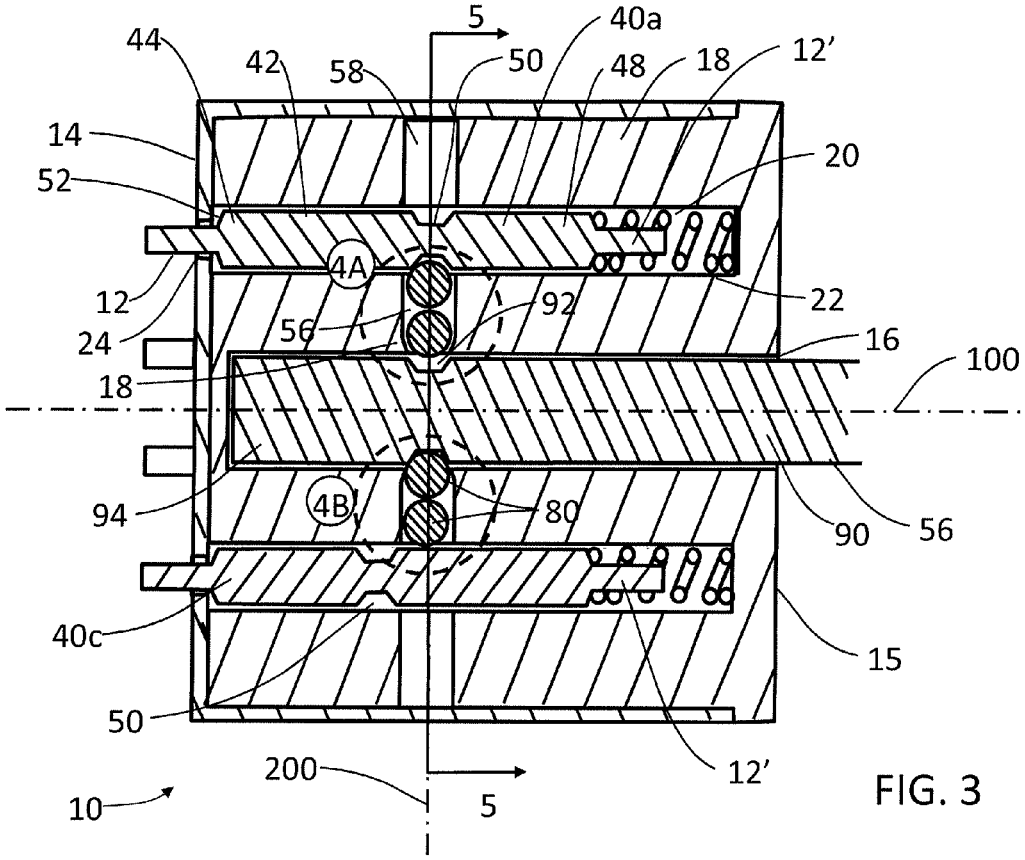
FIG. 3 shows a sectional view of the locking device through line 3-3 of FIG. 2.

As shown in FIGS. 2 and 3, the push-button locking device 10 has a substantially body, illustrated as a cylindrical body 18, with an axis, illustrated as a central axis 100, and has a front face or surface 14 through which a plurality of pushable button(s) 12 extend, and a rear face or surface 15 having a post bore, illustrated as a cylindrical central bore 16, therethrough, onto which the post 90 is installable and securable. Each push button 12 is associated with an elongated control pin 40 that is moveable axially within the body 18 of the lockable device 10. The plurality of control pins 40 are disposed within pin bores 20 arranged around the post bore, illustrated as arranged radially around the central bore 16 at equal spacing radially from the central axis 100 and circumferentially from one another. The plurality of pin bores can be disposed at a distance from the post bore that are the same or different; if different, the tumbler channel and tumbler(s) lengths, described herein after, are selected accordingly. Each control pin 40 is biased to a forward first position within the pin bore 20 with a biasing means, illustrated as a spring 22.

Each control pin 40 includes body having a periphery along its length and in cross section, illustrated as a cylindrical body having a periphery 42, and a first end 44 having a push end illustrated as the button 12, which extends through an opening 24 in the front face 14 of the locking device in the biased-forward first position. A recess 50 is formed into the periphery 42 intermediate the first end 44 and second end 48. As illustrated, the recess 50 extends around the entire circumference of the pin to form an annular recess. The recess 50 and its center are disposed a selected fixed distance from the first end 44 of the control pin 40. The first end 44 of the control pin 40 includes the reduced-diameter button 12 that extends from a shoulder 52, and through the opening 24 in the front face 14.

The post 90 has a recess formed at distance from the distal end 94 of the post associated with each of the control pins 40. As illustrated, the plurality of recesses associated with the plurality of control pins 40 can comprise an annular recess 92 formed around the a portion of or the entire circumference of the post 90. The annular recess 92 is provided to receive tumblers 80 associated with each of the control pins 40 for securing the lockable device 10 to the post 90, as described herein after.

Figure 4A:
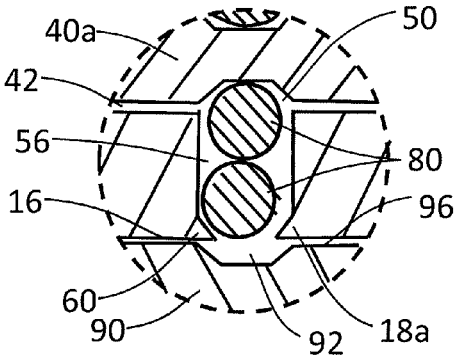
FIGS. 4A and 4B show detailed views of the features in FIG. 3.

Each pin bore 20 communicates with the central bore 16 through a tumbler channel, illustrated as a cylindrical tumbler channel 56, that extends radially from, and intersects, the central bore 16 to and with the pin bore 20. As illustrated, tumbler channel 56 associated with each control pin 40 and each pin bore 20 is formed in the body 18 the same distance axially from the front face 14 of the device, to standardize the lengths and features of the control pins 40. Each tumbler channel 56 is formed along a transverse or radial axis 200, perpendicular to the central axis 100. To aid in forming the cylindrical pin channels 56, an outer channel bore 58 is started through the outer circumference of the body 18, to extend radially inwardly to and through the pin bore 20, and continuing radially inwardly to the central bore 16 to form the tumbler channel 56. As can be seen in FIG. 4A, the tumbler channel 56 of fixed diameter penetrates only partially (not completely) through the wall portion 18*a* that defines the central bore 16, to leave an annular shoulder 60 at the junction of the tumbler channel 56 and the central bore 16. The annular shoulder 60 defines an opening into the central bore 16 from the tumbler channel 56 that is smaller in diameter than the diameter of the tumbler channel 56, and smaller in diameter or size than the diameter (or minimum dimension) of the tumbler 80. The shoulder prevents a tumbler 80 from moving from the tumbler channel 56 into the central bore 16 when the post 90 is withdrawn. The outer channel bore 58 also permits loading of the tumbler pin(s) from outside during assembly and during reprogramming of the lock device.

Figure 4B:
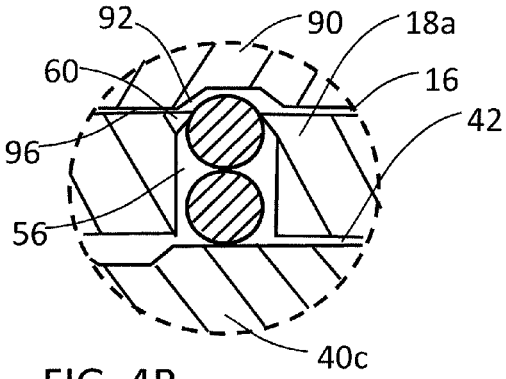
Figure 5:
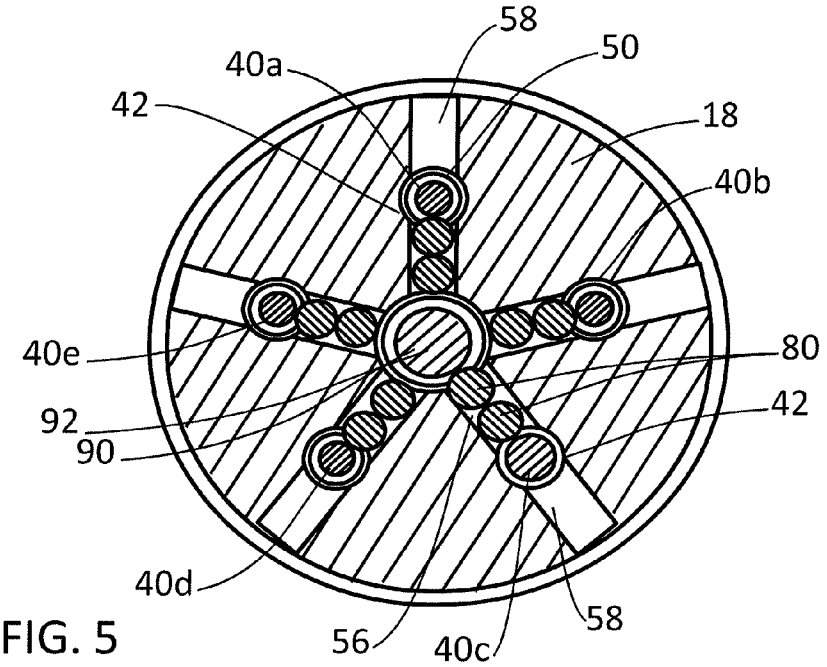
FIG. 5 shows an axial section view of the locking device through line 5-5 of FIG. 3.

FIGS. 3 and 5 show the device 10 with all of the control pins 40 biased forwardly, with a major portion of the buttons 12 extending forwardly, outwardly from the face 14. The distance through the wall portion 18*a* between the outer periphery of the pin bore 20 and the outer periphery of the central bore 16 is less than the dimension of the one or more tumblers 80 disposed, in total, which are accommodated by and disposed within the tumbler channel 56. Each of the tumblers 80 disposed within each cylindrical tumbler channel 56 extend at least partially, and usually fully, into either the central bore 16 or its respective pin bore 20, or both, since the dimension of the tumbler 80 (or aligned with tumblers 80), from end to end, exceeds the distance between the pin bore 20 and the central bore 16. With the post 90 disposed within the central bore 16 as shown in FIG. 3, for any one control pin 40, at least one of the groove 92 of the post 90 or the groove 50 of the control pin 40 is aligned with the tumbler channel 56. In FIGS. 3 and 4A, the annular groove 50 of the first control pin 40*a* and the annular groove 92 of the post 90 are both aligned axially with the first tumbler channel 56, such that the tumbler(s) 80 cannot be forced to reside within the annular groove 92 of the post 90, and will not prevent the withdrawal of the post 90 from the lockable device 10. FIGS. 3 and 4B show that the annular groove 50 of third control pin 40*c* is not aligned axially with the third tumbler channel 56, which forces its tumbler(s) 80 into the annular groove 92 of the post 90. The larger circumferential or diameter of the periphery 96 of the post 90 cannot clear axially past the tumbler(s), and interferes with removal of the lockable device 10 from the post 90.

FIG. 5 also shows that the grooves 50 of control pins 40*a*, 40*b*, 40*d*, and 40*e* are aligned with their respective tumbler channels 56 when in their biased-forward first positions, termed these pins' neutral unlock position. Only the groove 50 of control pin 40*c* (shown in FIG. 3) is out of alignment axially with its tumbler channel 56 when in its biased-forward first position, termed this pin's neutral lock position, and the larger outer periphery 42 of the control pin 40 forces the tumblers 80 into the groove 92 of post 90, preventing the post 90 from being withdrawn out of its central bore 16.

Figure 6:
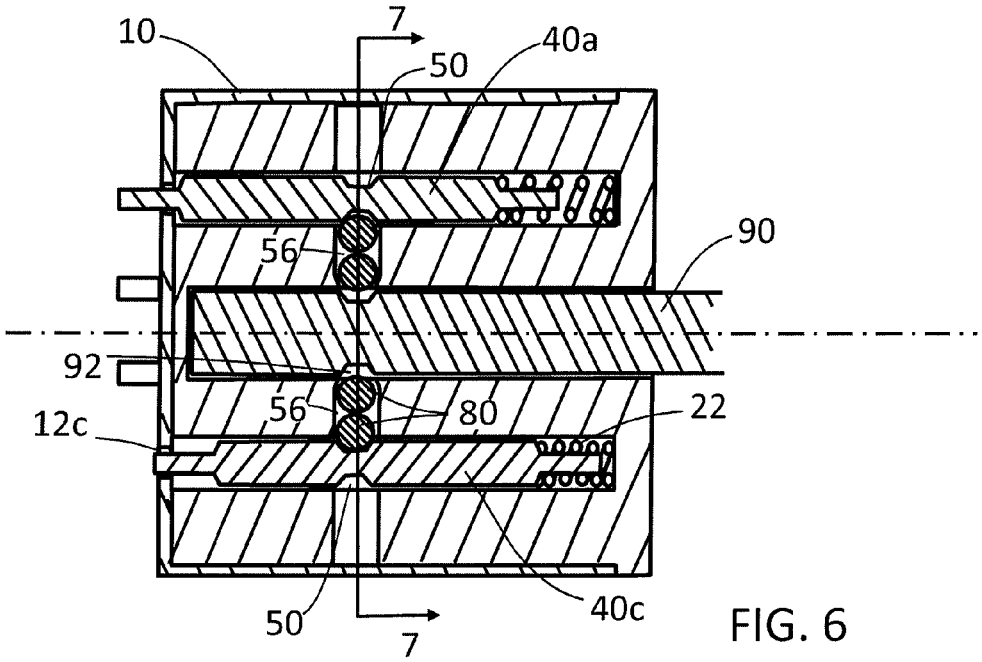
FIG. 6 shows the axial section view of the locking device of FIG. 5 with a pin depressed.
Figure 7:
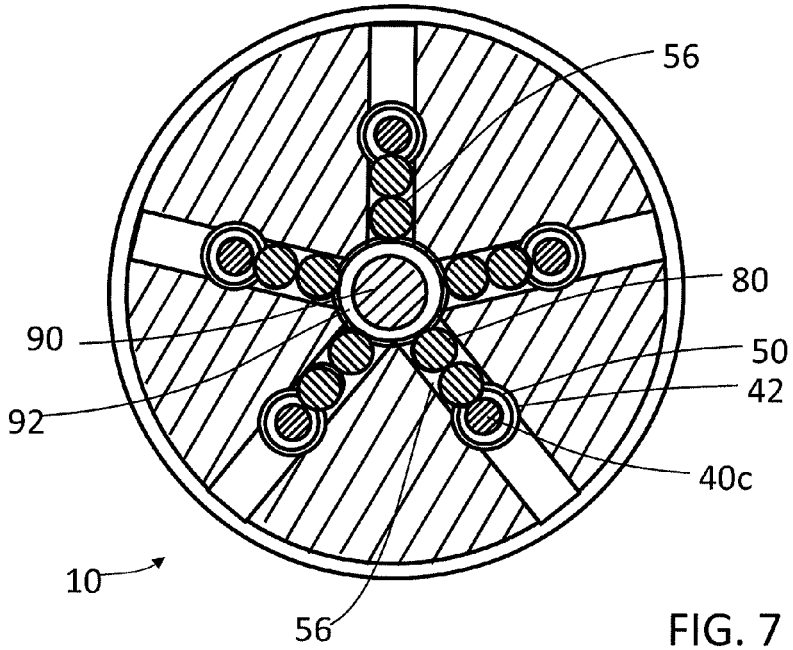
FIG. 7 shows an axial section view of the locking device through line 7-7 of FIG. 6.
Figure 8:
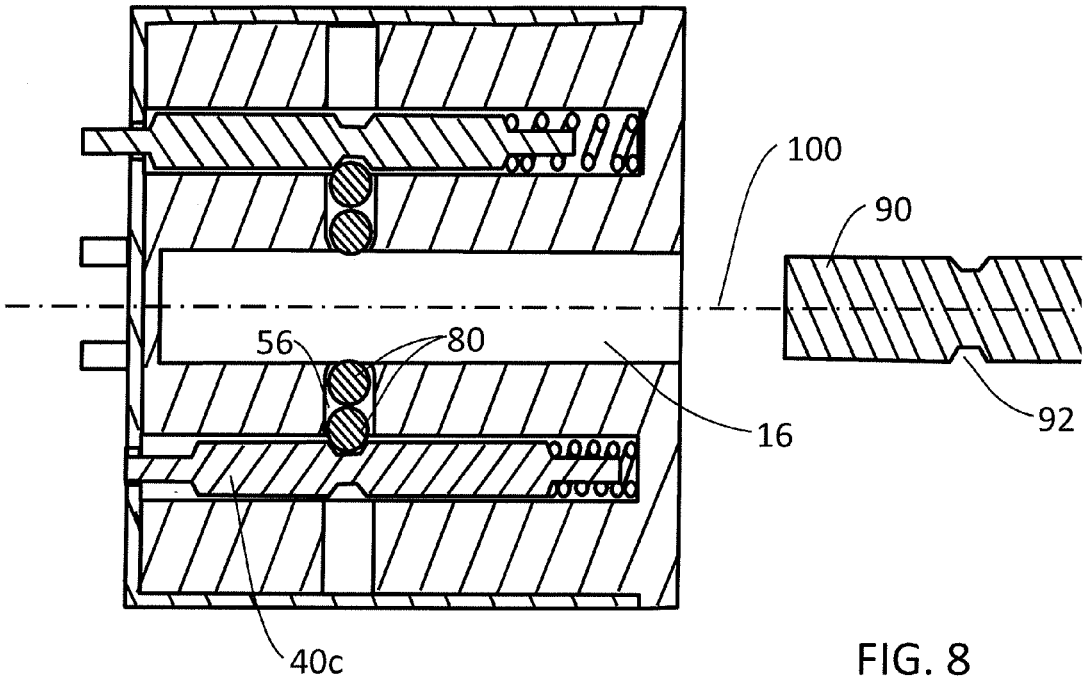
FIG. 8 shows the locking device removed from the post.
Figure 9:
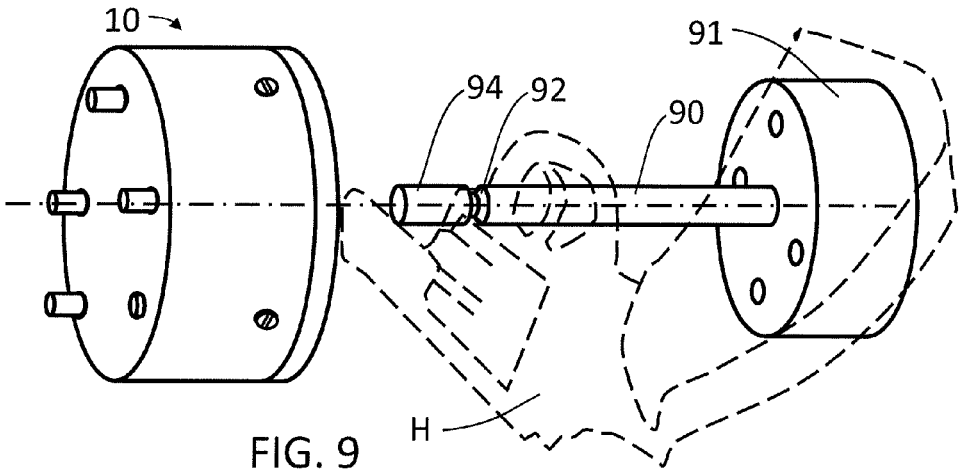
FIG. 9 also shows the locking device removed from the post to unlock the article.

As illustrated in FIGS. 6 and 7, when both the groove 92 of the post 90 and the groove 50 of a control pin 40 are aligned axially with the tumbler channel 56, then the tumbler(s) 80 will be moved, or biased out of, the groove of the post 90 when an axial force is exerted against the inwardly-facing end of the tumbler by the periphery 96 of the post 90. When the grooves 50 of all of the control pins 40 are aligned axially with their respective tumbler channels 56, then the radially-inward ends of the tumblers 80 will move out of the annular groove 92 of the post 90 and substantially fully into the tumbler channel 56, and the lockable device 10 can be withdrawn off of the post 90, as illustrated in FIGS. 8 and 9.

FIG. 6 shows a sectional view along the axis 100 through control pin 40*a* and control pin 40*c*, after control pin 40*c* has been fully depressed by the user. The depressing of button 12*c* of control pin 40*c* compresses the spring 22 further, and aligns the pin groove 50 with its tumbler channel 56. FIG. 7 provides a transverse cross sectional view through the five tumbler channels 56, showing that the groove 50 of control pin 40*c*, which has been depressed to its biased position, aligns with its tumbler channel 56. The tumbler(s) 80 of control pin 40*c* are moveable from out of the annular groove 92 of the post 90 and out of interference with the periphery 96, and into the tumbler channel 56 and groove 50 of the control pin 40*c*, allowing the larger outer periphery 96 of the post 90 to be withdrawn past the tumblers and from its central bore 16, as shown in FIGS. 8 and 9. As FIG. 9 also illustrates, an apparatus or article, shown as a handgun, can be mounted on the post 90 (typically with the post disposed behind the trigger), and locked and unlocked to the post 90 by the lockable device 10.

Figure 10:
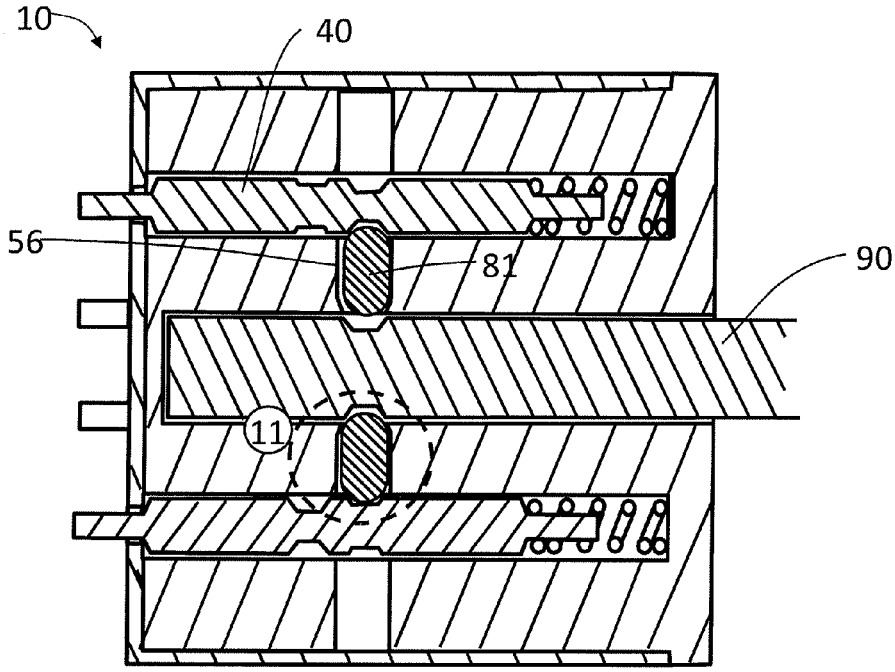
FIG. 10 shows an alternative embodiment of a tumbler.

The tumbler(s) 80 are illustrated as spherical balls, allowing them to roll and move easily along the tumbler channels 56 and into and out of the grooves. Alternative tumblers can include an elongated cylindrical tumbler 81 with rounded ends as shown in FIG. 10, or any other shape and size that spontaneously is biased from a groove 92 of the post 90 when an axial force is applied against the tumbler 80 by the peripheral edge of the groove.

The grooves 50,92 of the control pins 40 and the post 90 are configured and designed to allow the selected tumbler 80 to be biased outward from the post's groove 92 merely by axial movement of the post 90 against the tumbler 80. The grooves 50, 92 are illustrated as annular rectilinearly-formed troughs having tapered sides. The groove can also have just a rectalinear trough, or a curved (parabolic) groove, or a V-shaped groove. Typically the depth of the groove 50,92 from the outer periphery of the control pin 40 or post 90 is less than the radius of the spherical tumbler.

It can be understood that numerous other lock combinations are available among the five (5) pins of the first embodiment. It is presumed that at least one of the five control pins 40 is in a neutral lock position. Combinations thus include any one pin in a neutral lock position (5 combinations), any two pins (10 combinations), any three pins (10 combinations), any four pins (5 combinations), and all five pins (1 combination), for a total of 31 combinations. The lockable device 10 is both installed onto the post 90, and removed from the post, by depressing and holding the programmed combination of buttons 12, which moves and keeps each of the grooves 50 of the control pins 40 in alignment axially with their respective tumbler channels 56, allowing the tumblers 80 to move clear of the post groove 92.

FIG. 3 also illustrates another aspect of the invention, wherein the control pins 40 are reversible, having a button 12' on the opposite second end, and having the annular groove 50 positioned axially off-center; that is, closer to one or the other of first end 44 and second end 48. Control pins 40*a* and 40*c* are the same pin design and dimensions. Control pin 40*a* is installed with the groove 50 disposed rearward of the axial center point of the pin, while control pin 40*c* installed in the opposite orientation, with the groove 50 disposed forward of the axial center point of the pin. It can therefore be readily understood that the combination of the lockable device can be changed by withdrawing and turning over (switching the orientation of) one or more of the control pins 40.

Figure 11:
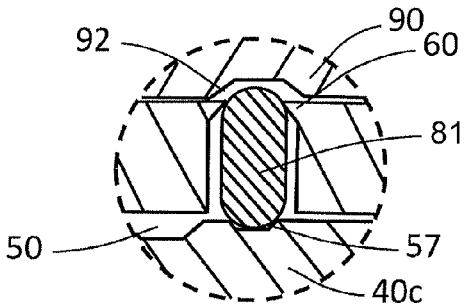
FIG. 11 shows a detailed view of the features in FIG. 10.
Figure 14:
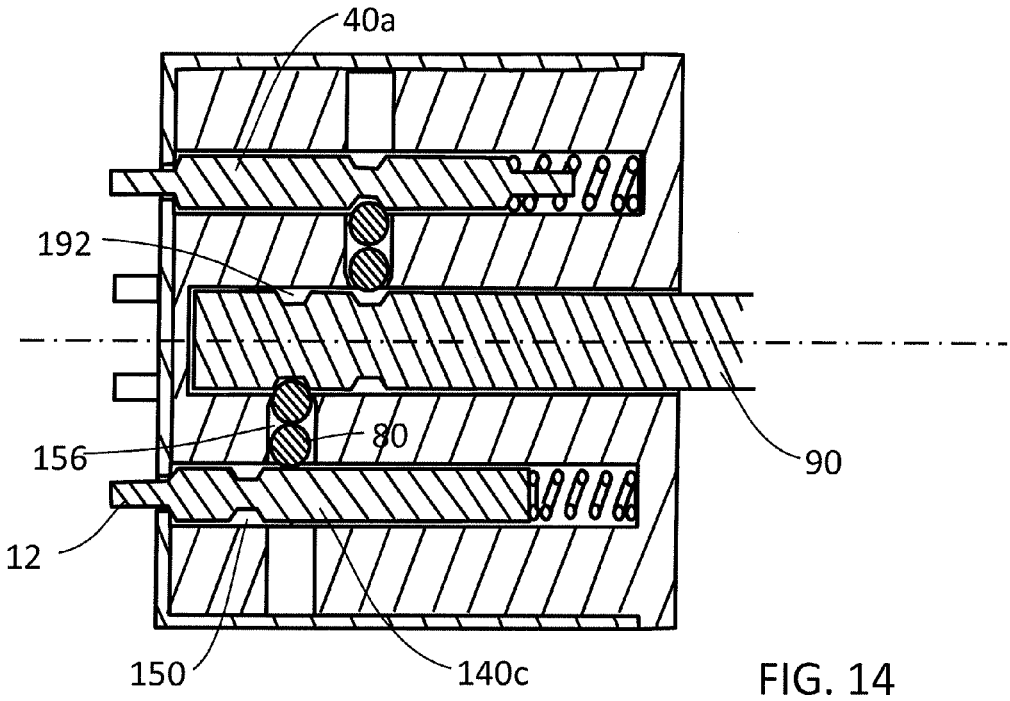
FIG. 14 shows a sectional view of the locking device through line 14-14 of FIG. 13.

FIG. 11 shows the detail features in FIG. 10, and illustrates another aspect of the invention that provides a resistance to tampering. A control pin 40 (shown as control pin 40*c*) includes a recess 50 and a dimple recess 57 disposed axially from the recess 50. The dimple recess 57 aligns with the tumbler channel 56 when the pin is in its neutral lock position; that is, when the pin in its biased-forward position and its recess 50 is out of alignment with the tumbler channel 56.

Figure 12:
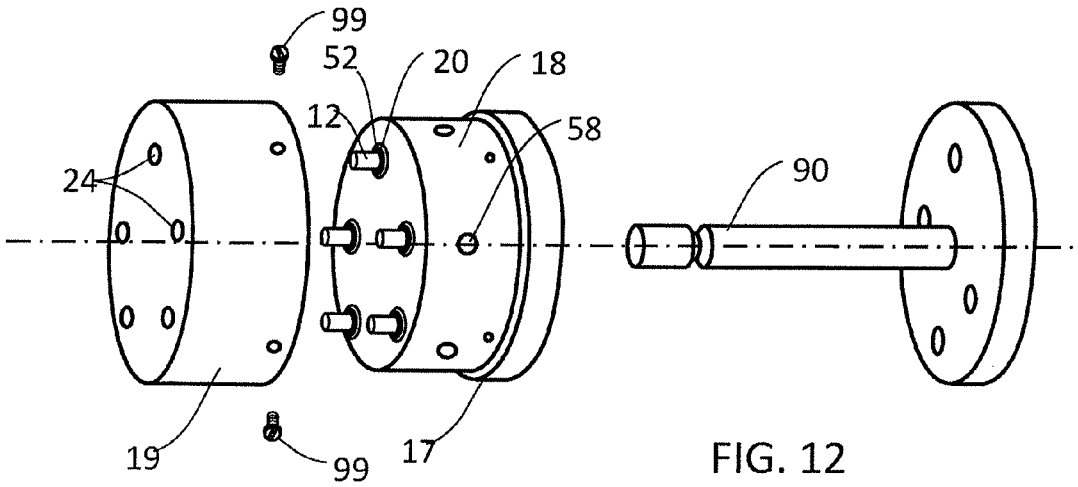
FIG. 12 shows an exploded view of the assembly of the locking device.
Figure 13:
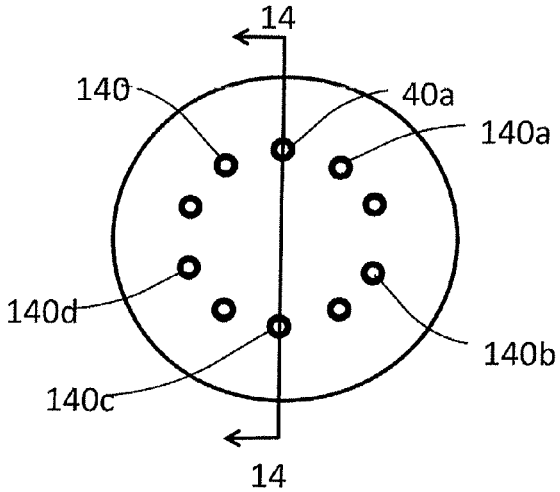
FIG. 13 shows a front face view of another embodiment of the locking device.

FIG. 12 shows an exploded view of the lockable device, post and base of the first embodiment of the gun lock system. A cylindrical cap 19 fits over the outer cylindrical body 18, and seats against an apron or outer flange 17 extending near the rear face. Screws 99 secure the cap 19 to the body 18.

FIG. 13-16 illustrate another aspect of the invention, which provides a second set of pins 140 communicating through tumblers 80 with a second groove 192 in the post 90 though a second set of tumbler channels 156 displaced axially from the first set of channels 56 of the first set of control pins 40. The second set of pins 140 are disposed in respective pin bores 150 arranged radially from the central bore 16 and spaced circumferentially from and between the pin bores 20 of the first set of control pins 40.

Figure 15:
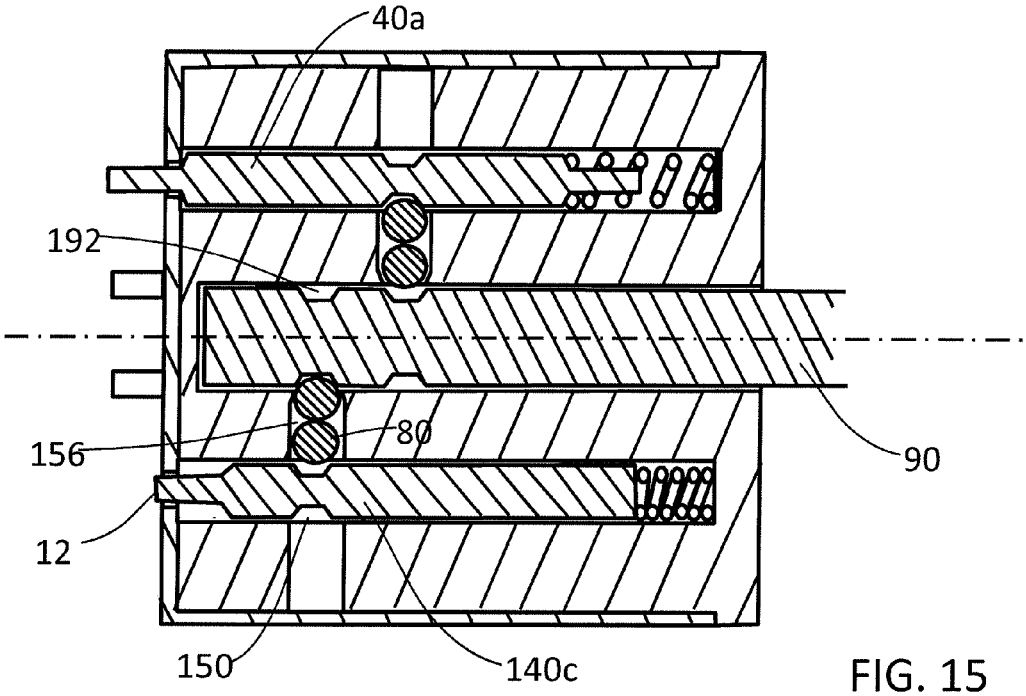
FIG. 15 shows the locking device of FIG. 14 in another configuration.
Figure 16:
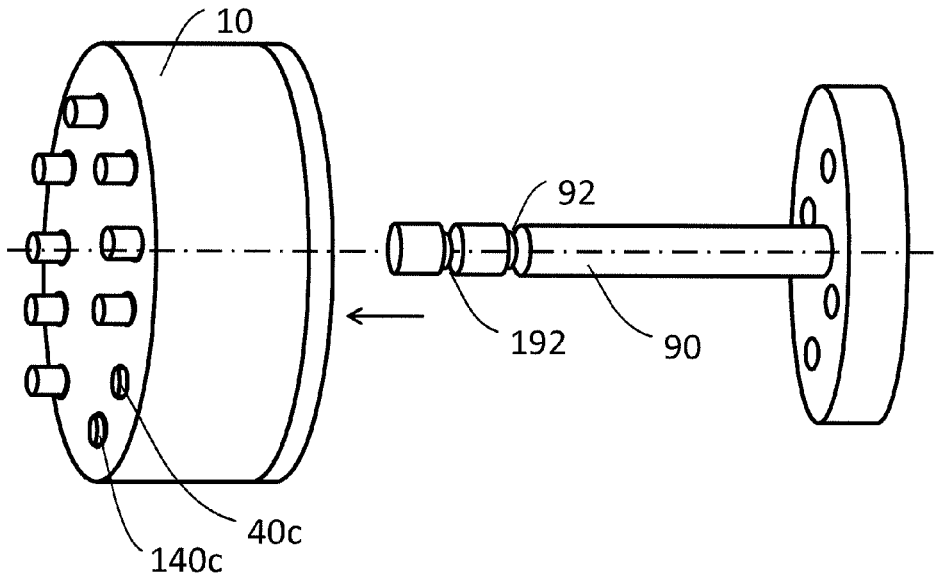
FIG. 16 shows the locking device of FIG. 13 removed from the post.

As taught herein, in the second set of pins 140 that including pin 140*a*, pin 140*b*, pin 140*c*, and pin 140*d*, one pin 140*c* is in a neutral lock position, with the remaining pins 140 being in neutral unlock positions. By depressing and holding depressed both the button 12 of control pin 40*c* and the button 12 of pin 140*c*, simultaneously or sequentially in any order, the respective pin recesses 50 and 150 are aligned with the tumbler channels 56 and 156, the locking device can be withdrawn from the post 90, and the article unlocked, as shown in FIGS. 15 and 16.

Figure 17:
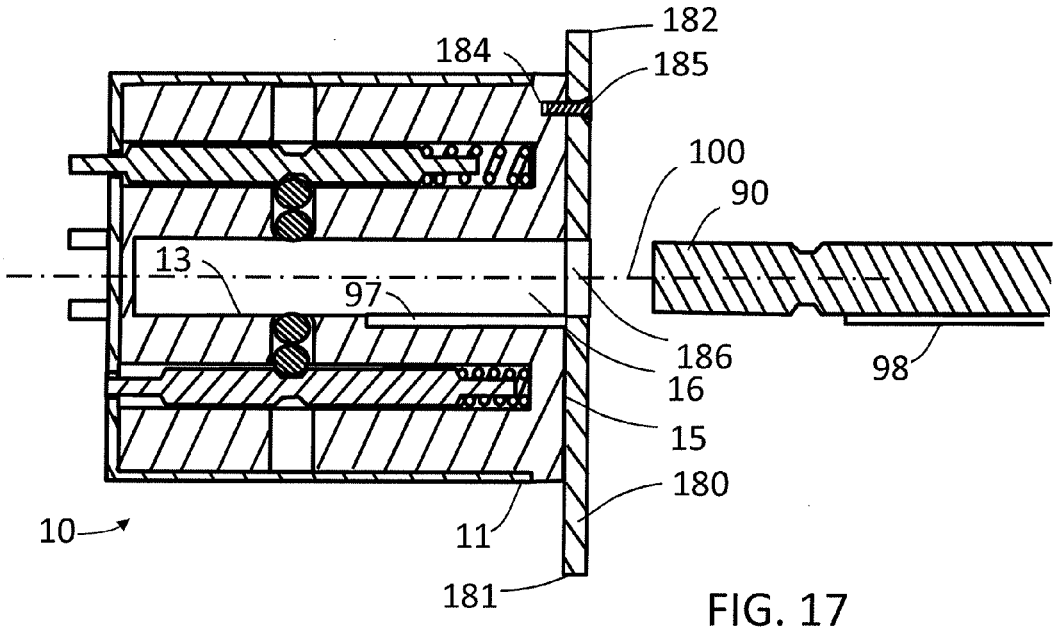
FIG. 17 shows a sectional view of a locking device having an extending member.
Figure 18:
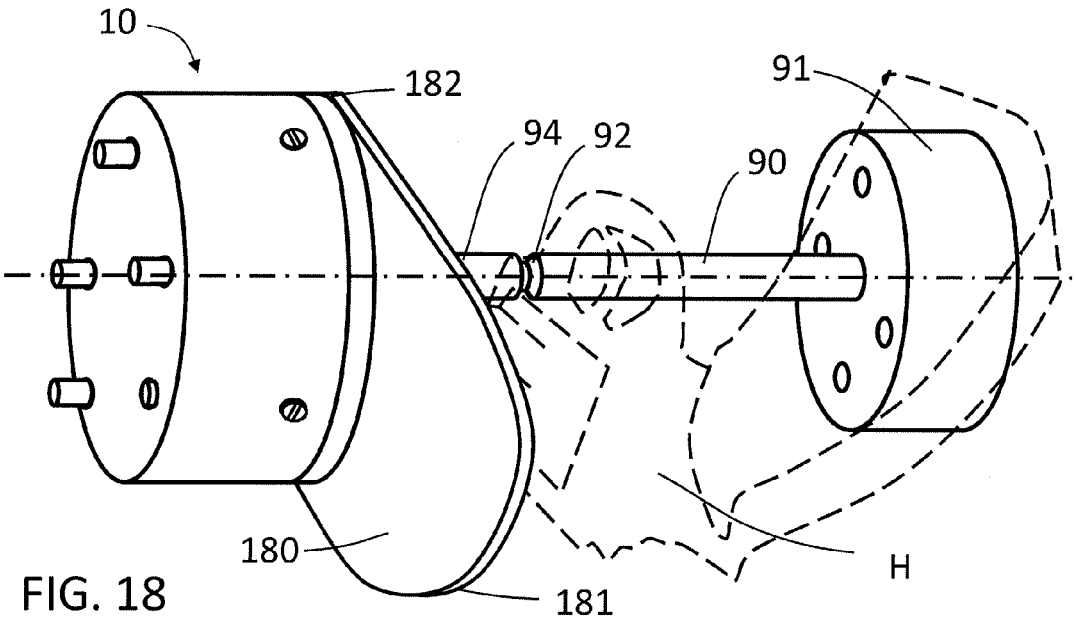
FIG. 18 shows the locking device having an extending member.
Figure 19:
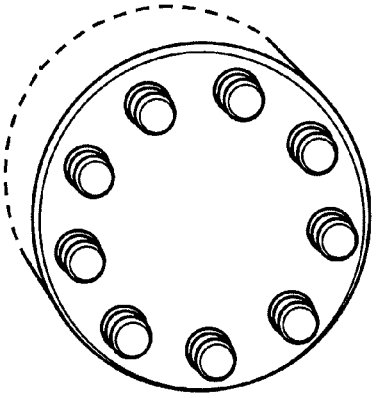
FIG. 19 shows a perspective view of a locking device.
Figure 20:
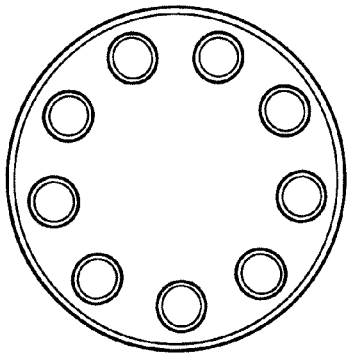
FIG. 20 shows a front view of the locking device.
Figure 21:
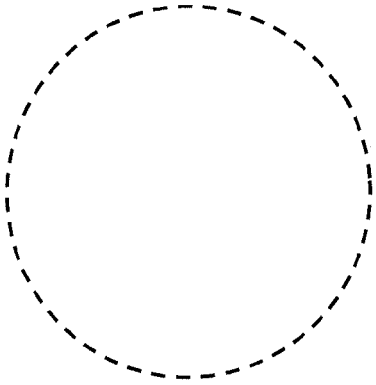
FIG. 21 shows a back view of the locking device.
Figure 22:
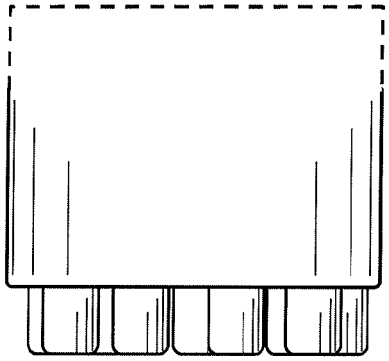
FIG. 22 shows a top view of the locking device.
Figure 23:
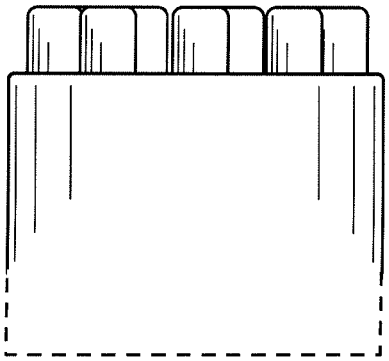
FIG. 23 shows a bottom view of the locking device.
Figure 24:
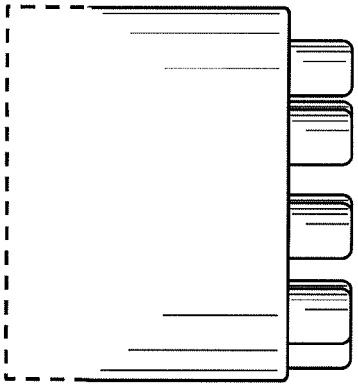
FIG. 24 shows a left side view of the locking device.
Figure 25:
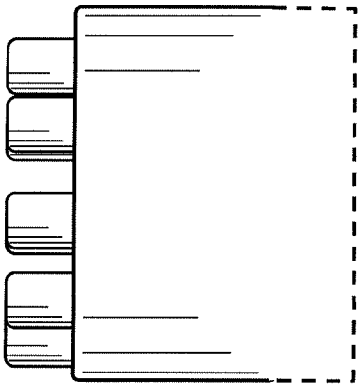
FIG. 25 shows a right side view of the locking device.

FIG. 17 shows a sectional view of another aspect of a locking device, having an extending member. The extending member is a plate 180 having a periphery with a portion thereof that extends beyond the lateral periphery 11 of the lockable device 10. The periphery of the plate can extend from only one portion of the lockable device, or can have opposite extending portions 181 and 182 as shown in FIG. 16, or can extend outwardly all around the lockable device 10 or any other arrangement. The extension of the plate 180 can be asymmetrical or symmetric about the periphery 11 of the lockable device 10. The plate is typically planer, and can be made of any durable, non-bendable material, or bend-resistant material. A non-limiting example of the material is steel. The plate 180 can be secured to the rear face of the locking device 10 using any conventional fastening means, such as a threaded hole 184 in the rear face of the locking device body and a threaded screw or bolt 185. The plate 180 includes an aperture 186 there through that registers with the central bore 16. When the locking device is secured to the post 90 with a handgun mounted on the post, the extending member can extend outwardly to cover the view or access to a trigger or other feature of the handgun. As shown in FIG. 18, the extending plate can inhibit or block access to a feature of the handgun, such as a trigger, hammer, or magazine clip release button.

FIG. 17 also shows another aspect of the invention of a means for rotational alignment or rotational selectivity of the locking device. An elongated slot 97 of selected width and radial depth is formed axially into the cylindrical inner wall 13 of the body 18 from the opening in the rear face. The post 90 includes an elongated, axially-extending rib 98, proximally from the groove 92, which has a shape to register with the slot 97 to require that the locking device 10 be properly rotated about the central axis 100, with the slot 97 aligned with the rib 98, in order to be mounted and installed onto the post 98, and to prevent rotation of the locking device 10 after it securement to the post 90.

It can also be understood that the shape of the body of the lockable device, though illustrated as cylindrical, can be other shapes, including square, rectangular, oval, polygonal, and other irregular shape in cross section, and along its axis. Similarly, the post bore can be made, in cross section, in other shapes than cylindrical, including square rectangular, oval, and polygonal, with the one or more post grooves in the periphery, or a continuous peripheral groove, with the tumbler channels extending outwardly, including radially outwardly, to the associated pin bores. The post bore can also be positioned in other positions axially into the body of the lockable device, other than centrally, including off center, along a periphery of the body, etc. The pin bores as well can arranged in a pattern that follows the periphery of the post bore, or can be in any pattern provided the tumbler channels can extend to the periphery of the post bore.

FIGS. 19-25 show an ornamental design of an article locking device of the present invention. The broken lines in FIGS. 19-25 of the drawings are included for the purpose of showing portions of the document holder that form no part of any claimed design.

I claim:

1. A pin lock device for securing an article, including a lock base and a removable cylindrical lock member that locks to the lock base, the lock base having a proximal end and a distal end, including a cylindrical post having an annular groove proximate the distal end;

the cylindrical lock member having a body, a central axis, a front face, and a rear face, a central bore into the body along the central axis and through the rear face that is configured to accept the post, a plurality of pin bores disposed in the body and displaced radially from the central axis, a radial tumbler channel extending between each pin bore and central bore, and a plurality of button openings in the front face of the cylindrical lock member in communication with the pin bores;

a control pin disposed in each pin bore, the control pin having a body, a first end and an opposed second end, the first end including a button portion that extends through the button opening in the front face of the cylindrical lock member, and having a pin recess formed in the body intermediate the first end and second end, the control pin moveable within the pin bore between an extended position with the button extending from the front face, and a depressed position disposed rearwardly from the extended position; and a tumbler disposed within each tumbler channel, configured for radial movement within the tumbler channel between at least one of the annular groove of the post when disposed within the central bore or the pin recess.

2. The lock device according to claim 1 wherein the tumbler consists of two or more balls.

3. The lock device according to claim 1 wherein the control pin body is cylindrical and the recess is an annular recess.

4. The lock device according to claim 1 wherein the pin bores are bored through the front face of the body, and further including a cylindrical cover having a front face having button openings, and a cylindrical sidewall secured to the body.

5. The lock device according to claim 1 further including a spring within each pin bore at the second end of the control pin for biasing the control pin toward the front face.

6. The lock device according to claim 1 wherein the button portion is a reduced diameter.

7. The lock device according to claim 1 wherein the control pins include a button portion on the second end, and the pin recess is off center between the first end and the second end.

8. The lock device according to claim 1 wherein the removable lock member is removable from the cylindrical post of the lock base when, for each control pin, the tumbler disposed within each tumbler channel is disposed in or has moved into the pin recess of the control pin.

9. The lock device according to claim 8, wherein the lock base is configured for securing an article having an opening, by mounting the article onto the lock base with the lock post through the opening of the article, and returning and locking the lock member onto the cylindrical post of the lock base.

* * * * *